US007993076B2

(12) United States Patent
Hopf

(10) Patent No.: US 7,993,076 B2
(45) Date of Patent: Aug. 9, 2011

(54) BLUFF PENETRATING OUTFALL DRAINAGE SYSTEM

(76) Inventor: Ken L. Hopf, Bellingham, WA (US)

( * ) Notice: Subject to any disclaimer, the term of this patent is extended or adjusted under 35 U.S.C. 154(b) by 346 days.

(21) Appl. No.: 12/247,759

(22) Filed: Oct. 8, 2008

(65) Prior Publication Data

US 2010/0086356 A1 Apr. 8, 2010

(51) Int. Cl.
*E02B 13/00* (2006.01)
*E02B 11/00* (2006.01)

(52) U.S. Cl. ..... 405/43; 405/39; 405/45; 405/53

(58) Field of Classification Search ..... 405/36, 405/39, 43, 44, 45, 51, 52, 53, 124, 125, 405/126

See application file for complete search history.

(56) References Cited

U.S. PATENT DOCUMENTS

| | | | | | |
|---|---|---|---|---|---|
| 599,719 | A * | 3/1898 | Manning | 405/43 |
| 1,344,656 | A * | 6/1920 | Saltsman | 405/39 |
| 1,866,826 | A * | 7/1932 | Strothmann | 405/45 |
| 3,854,291 | A * | 12/1974 | Perkins | 405/108 |
| 4,666,334 | A * | 5/1987 | Karaus | 405/31 |
| 4,714,376 | A * | 12/1987 | Jenab | 405/45 |
| 4,820,080 | A * | 4/1989 | Varkonyi et al. | 405/45 |
| 4,919,568 | A * | 4/1990 | Hurley | 405/43 |
| 4,988,235 | A * | 1/1991 | Hurley | 405/50 |
| 5,015,122 | A * | 5/1991 | Combes | 405/36 |
| 5,297,895 | A * | 3/1994 | Johnson | 405/41 |
| 6,419,421 | B1 * | 7/2002 | Whitfield, Jr. | 405/36 |
| 6,612,778 | B1 * | 9/2003 | Jackson | 405/49 |
| 6,616,375 | B1 * | 9/2003 | Eriksson | 405/51 |
| 6,948,886 | B1 * | 9/2005 | Jackson | 405/302.6 |
| 7,153,060 | B1 * | 12/2006 | Bennion | 405/75 |
| 7,438,080 | B2 * | 10/2008 | Johnson | 405/36 |
| 7,540,953 | B2 * | 6/2009 | Fitzgerald | 405/36 |
| 2005/0042030 | A1 * | 2/2005 | Fu | 405/36 |

* cited by examiner

*Primary Examiner* — Frederick L Lagman
(74) *Attorney, Agent, or Firm* — Davis Wright Tremaine LLP; George C. Rondeau, Jr.; Heather M. Colburn

(57) ABSTRACT

A system and method to remove surface water from a watershed atop a hill behind a bluff to an outfall point near a toe of the bluff, and a method to build the system. The system includes a catch basin structure and a catch basin drain pipe directionally bored from the catch basin structure to the outfall point. The location of the catch basin is determined based on a location of the outfall point and a desired slope of the catch basin drain pipe. The catch basin structure has a catch basin with an opening near its bottom, and a cover structure that provides a sculpted, rounded and smooth transition from the opening to a reducing pipe coupled with the catch basin drain pipe.

16 Claims, 11 Drawing Sheets

BLUFF PENETRATING OUTFALL DRAINAGE SYSTEM

BACKGROUND OF THE INVENTION

1. Field of the Invention

The present invention is directed generally to surface water drainage systems, in particular, a system that discharges surface water through an outfall to a body of water such as a river, lake or ocean.

2. Description of the Related Art

Water that collects on the surface of the land from rain or other sources will typically follow the path of least resistance until it reaches a local low point, usually a body of water such as a river, lake or ocean. If the path is steep, significant erosion of the land may occur. In developed areas, erosion is highly undesirable. Erosion can degrade support for buildings on the land, which may damage or destroy such buildings. Hence the owners of developed land usually want to take active steps to minimize erosion.

Water that collects on a surface behind a bluff presents a particular challenge in minimizing erosion. Some water may be absorbed into the ground and flow through the ground towards the local low point. However, if the ground is saturated or significantly paved, surface water will flow, usually towards and over the bluff. This can lead to significant erosion at the top and bottom of the bluff.

One traditional solution has been to route the surface water into a trough or pipe that extends over a lip of the bluff. This solution reduces the direct erosion on the bluff. However, it may increase erosion in front of the bluff, which may have the effect of undermining the bluff and eroding the bluff none the less. Another traditional solution is to route a pipe down the face of the bluff. This solution has a disadvantage in that it is difficult to secure the pipe to a bluff that is erosive. It has a further disadvantage in that it degrades the natural beauty of the bluff.

DETAILED DESCRIPTION OF THE INVENTION

Figure 1A:
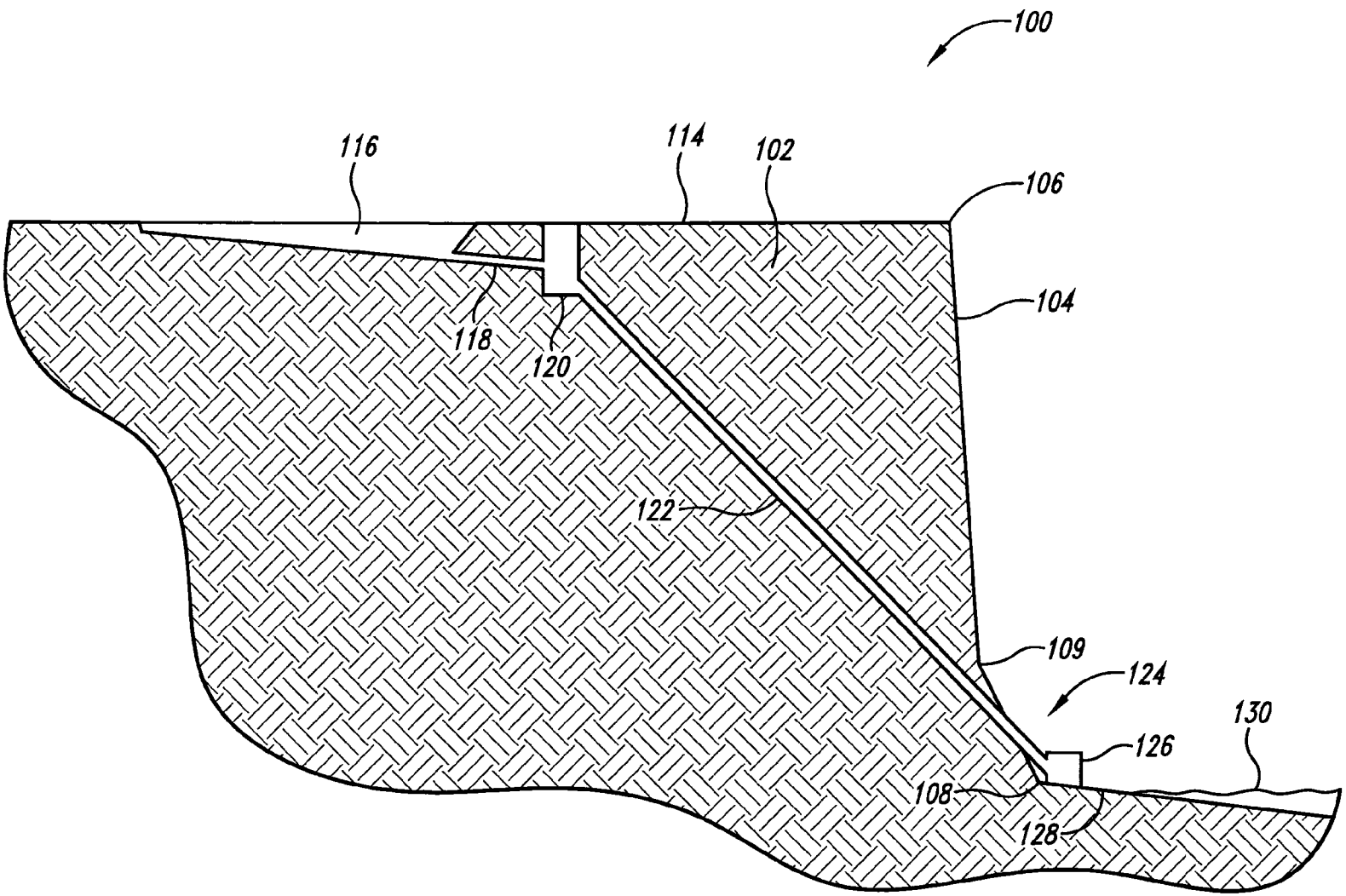
FIG. 1A is a cross-sectional side view drawing of an embodiment of a bluff penetrating outfall drainage system.
Figure 1B:
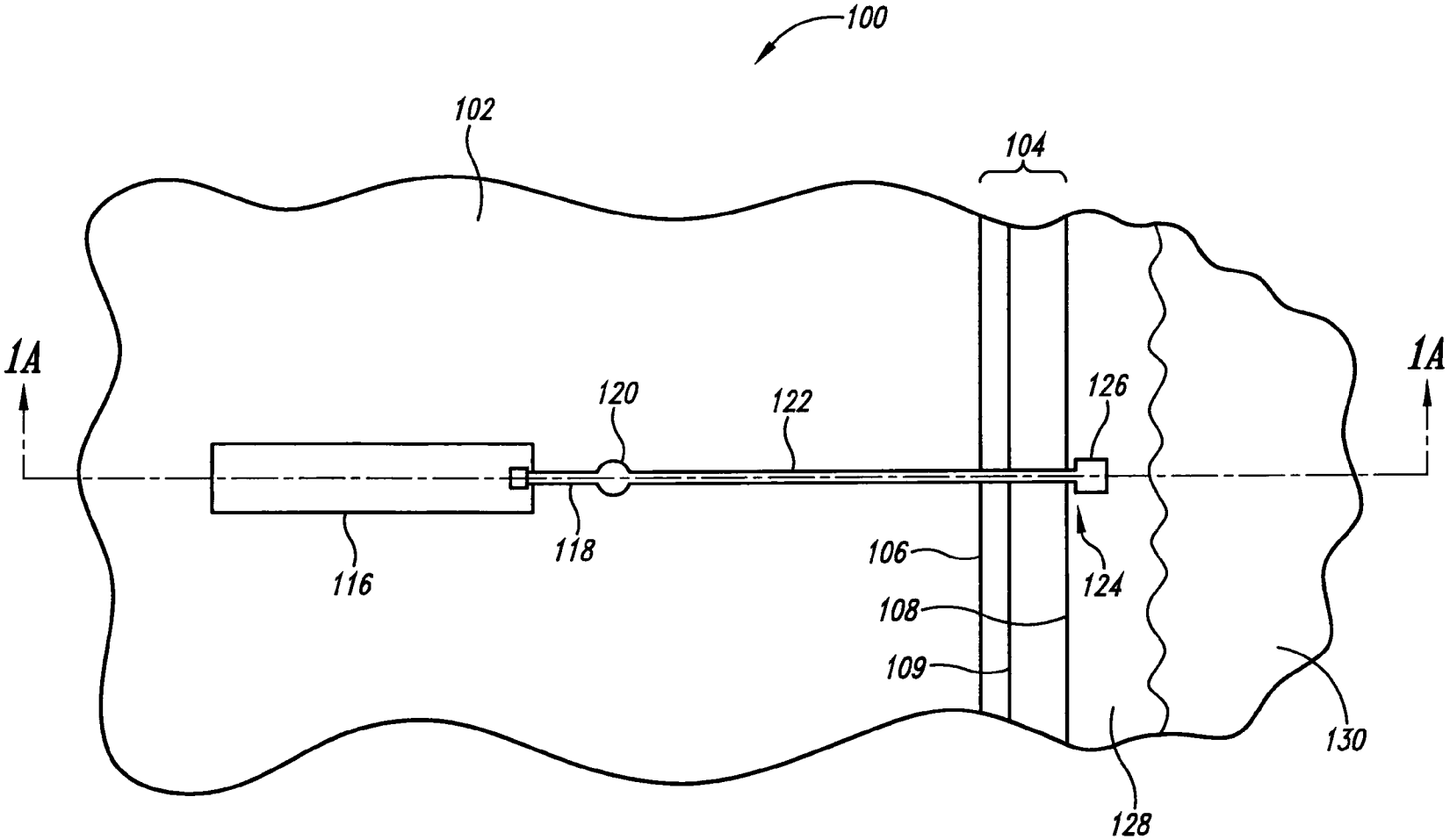
FIG. 1B is a top plan view of the embodiment of FIG. 1A.

FIG. 1A is a cross-sectional side view drawing of an embodiment of a bluff penetrating outfall drainage system 100. FIG. 1B is a top plan view of the embodiment of FIG. 1A.

The bluff penetrating outfall drainage system 100 is configured to remove surface water from on top of a hill 102 with a bluff 104 on a side of the hill.

The bluff 104 is a side of the hill 102 that has a slope of 100% or greater between two points on the hill 102, a bluff head 106 above and a bluff toe 108 below. The bluff 104 may have one or more sections that have local slopes of less than 100% while the overall slope from bluff head 106 to bluff toe 108 is greater than 100%. An object can be described as behind the bluff 104 if the object is not on the bluff 104 and is closer to the bluff head 106 than the bluff toe 108. An object can be described as in front of the bluff 104 if the object is not on the bluff 104 and is closer to the bluff toe 108 than the bluff head 106.

A bluff knee 109 is a point on the bluff 104 between the bluff head 106 and bluff toe 108. The portion of the bluff 104 between the bluff knee 109 and the bluff toe 108 has a slope of less than 100%, even though the overall slope of the bluff 104 between the bluff head 106 and bluff toe is greater than 100%.

The hill 102 has a hilltop 114 located behind the bluff 106. The hilltop 114 has a slope of less than 100% over at least the same horizontal distance behind the bluff 104 as the horizontal distance between the bluff head 106 and bluff toe 108. In the embodiment of FIGS. 1A and 1B, the hilltop 114 is a flat and generally level plateau. In other embodiments, the hilltop 114 is not a plateau and the hilltop 114 continues to gain elevation with distance from the bluff head 106. In yet other embodiments, the hilltop 114 losses elevation with distance from the bluff head 106.

A bluff base 128 extends in front of the bluff toe 108. The bluff base 128 includes everything beneath a surface of the bluff base. The bluff base 128 is not considered part of the hill 102. The bluff base 128 has a slope of less than 100% over at least the same horizontal distance in front of the bluff as the horizontal distance between the bluff head 106 and bluff toe 108. In some embodiments, the bluff base 128 is a rocky beach. In other embodiments, the bluff base 128 is a paved surface of concrete or similar material. The bluff base 128 extends to a low point 130 which may contain a body of water such as a river, lake or ocean, or just a lower elevation land surface.

The bluff penetrating outfall drainage system 100 includes a collection basin 116 disposed in the hilltop 104. The collection basin 116 is configured to collect surface water from the hilltop 104. Typically, the surface water originates from rain or other forms of precipitation. A collection basin drain pipe 118 is coupled with the collection basin 116 and is configured to drain the water that has collected in the collection basin 116. The collection basin drain pipe 118 is coupled to a catch basin structure 120. The catch basin structure 120 is configured to receive the water drained from the collection basin 116 by the collection basin drain pipe 118. Typically, the collection basin drain pipe 118 has a slight downward slope from the collection basin 116 to the catch basin structure 120. This allows the water in the collection basin 116 to flow by force of gravity alone through the collection basin drain pipe 118 to the catch basin structure 120. In some embodiments, a pump (not shown) may be used to move the water from the collection basin 116 to the catch basin structure 120.

A catch basin drain pipe 122 is coupled with the catch basin structure 120. The catch basin drain pipe 122 extends from the catch basin structure 120 through the hill 102. The catch basin drain pipe 122 is installed using directional boring techniques. A desired range for the slope of the catch basin drain pipe 122 is 30% to 100%. The catch basin drain pipe 122 exits the hill 102 at an outfall point 124. The outfall point 124 is near the bluff toe 108, within a distance equal to 25% of the elevation gain of the bluff 104. In this embodiment, the outfall point 124 is also below the bluff knee 109. In some embodiments, the outfall point 124 is also below the bluff toe 108.

A dispersal structure 126 is coupled with the catch basin drain pipe 122. In this embodiment, the dispersal structure 126 is disposed near the bluff toe 108. In other embodiments, the dispersal structure 126 is farther down the bluff base 128 and is coupled with the catch basin drain pipe 122 through an extension pipe. The dispersal structure 126 is configured to dissipate the kinetic energy and reduce the velocity that the water has gained in descending the catch basin drain pipe 122. The dispersal structure 126 is configured to disperse the water over an area of the bluff base 128 wider than the catch basin drain pipe 122 in order to minimize erosion. The water flows from the dispersal structure 126 over or through the bluff base 128 to the low point 130.

The piping used in this and the following exemplary embodiments is made of High-Density PolyEthylene (HDPE). However, other materials may be used without departing from the invention.

Figure 2A:
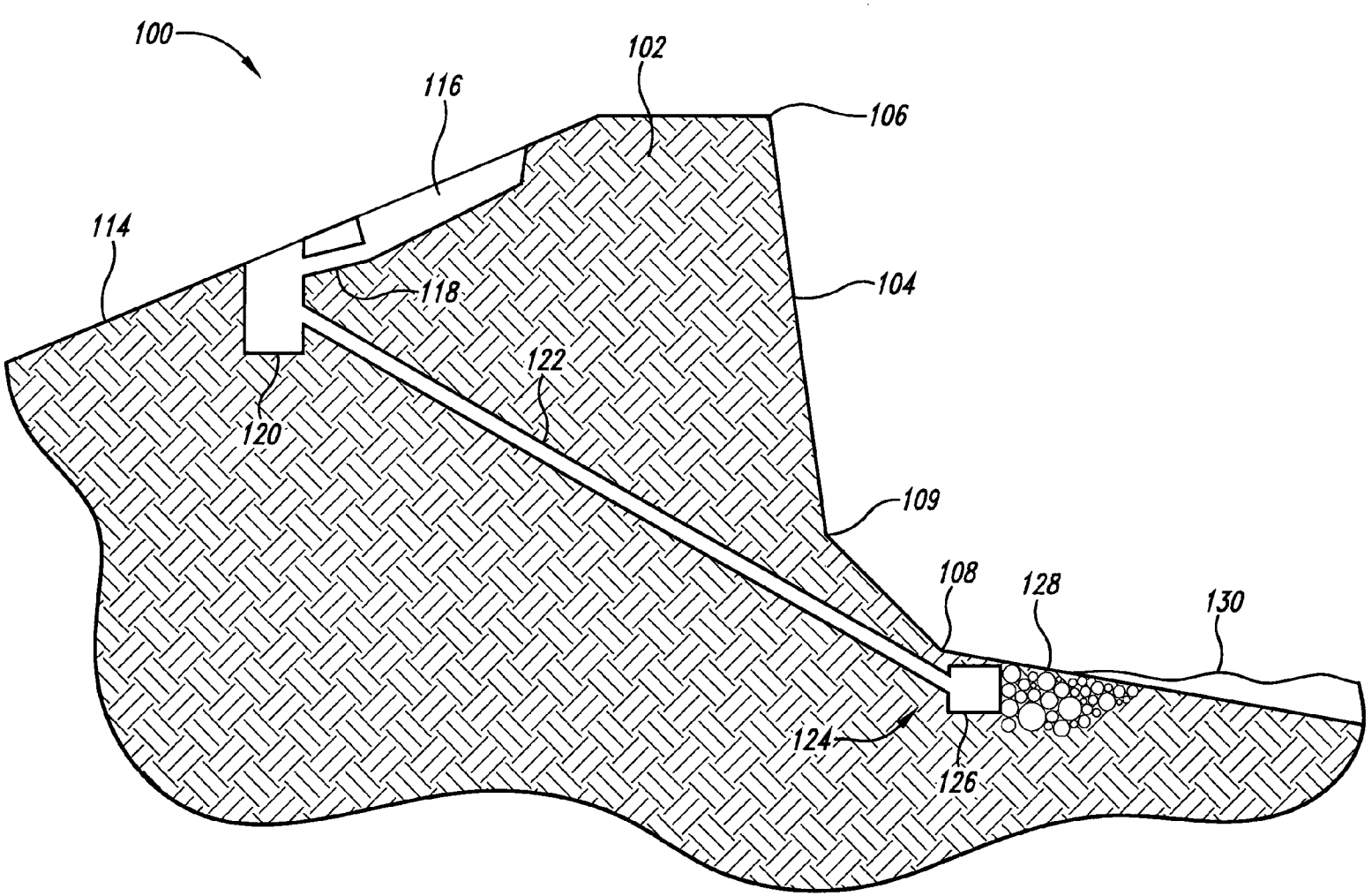
FIG. 2A is a cross-sectional side view of a second embodiment of a bluff penetrating outfall drainage system.
Figure 2B:
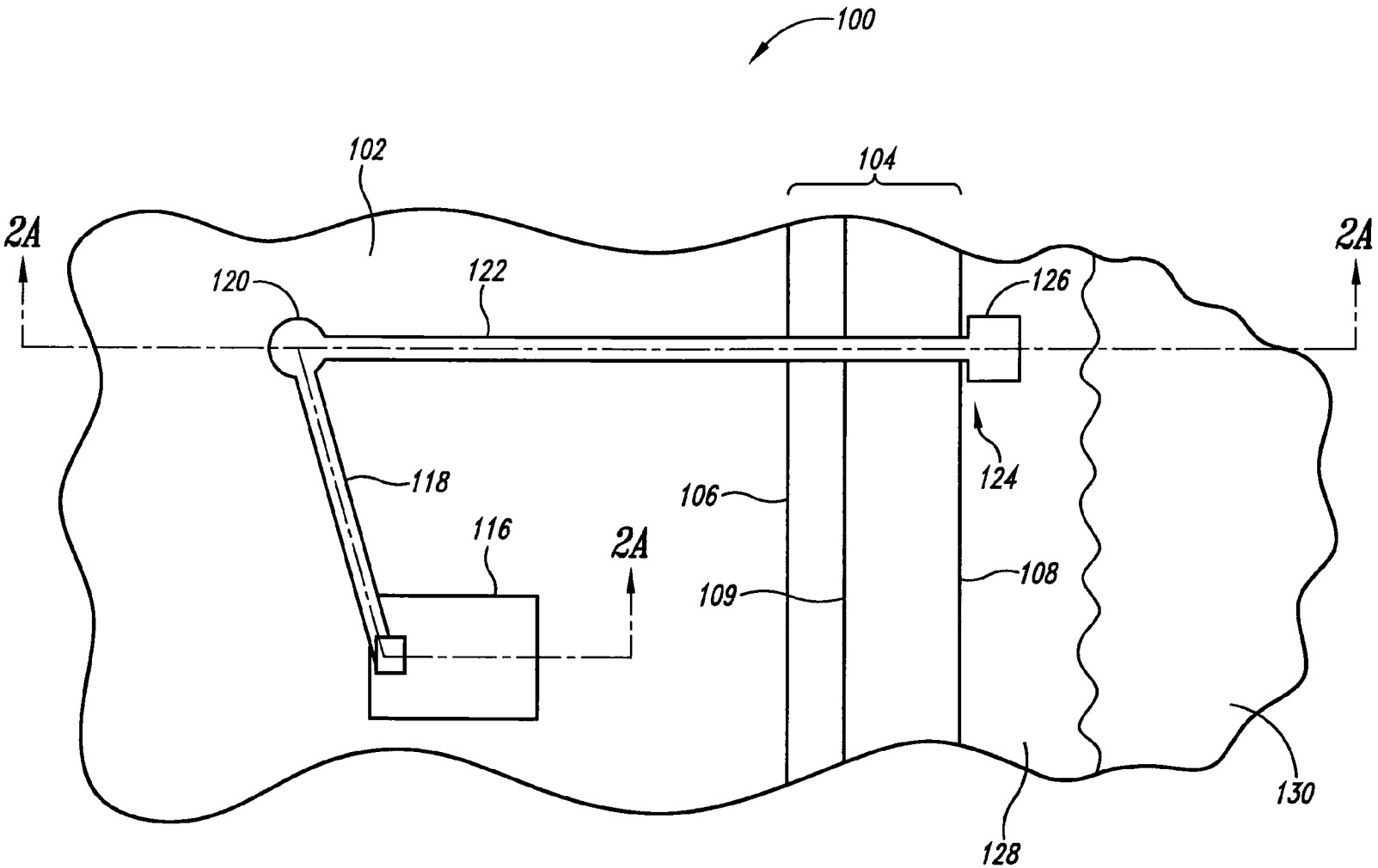
FIG. 2B is a top plan view of the embodiment of FIG. 2A.

FIG. 2A is a cross-sectional side view of a second embodiment of a bluff penetrating outfall drainage system 100. FIG. 2B is a top plan view of the same embodiment. In this embodiment, the hilltop 104 is not flat plateau, but loses elevation with distance from the bluff head 106. The catch basin structure 120 is positioned farther from the bluff head 106 than is the collection basin 116. This allows the collection basin 116 to drain by gravity into the catch basin structure 120 through the collection basin drainage pipe 118.

This embodiment also features the outfall point 124 located below the toe of the bluff 108 and below the surface of the bluff base 128. This has the advantage that once the bluff penetrating outfall drainage system 100 is installed, the bluff 106 and the bluff base 128 appear in a state that is nearly identical to the state before the installation. Water descending from the catch basin structure 120 through the catch basin drain pipe 122 is received 124 by the dispersal structure 126. In this embodiment, the bluff base 128 comprises a layer of small to medium size rocks. The rocks are sized to provide a high resistance path to water flowing at high velocity between the rocks of the layer, but a low resistance path to low velocity water. The rocks are typically four to eight inches in diameter. These rocks may be rounded beach rock or riprap. The rocks may have been placed on the beach naturally or artificially. The water dispersed from the dispersal structure 126 flows between the rocks of the bluff base 128 and enters the low point 130. A portion of the water may percolate above the bluff base 128 and flow over the rocks toward the low point. In this embodiment, the catch basin drain pipe 122 would exit the hill 102 in front of and below the bluff toe 108, in a pit excavated to facilitate installation of the dispersal structure 126 and connection to the catch basin drain pipe 122. The pit would then be backfilled with rock.

Referring to FIG. 2B, it can be seen that unlike the embodiment of FIGS. 1A and 1B, in this second embodiment the catch basin structure 120 is not in the same line as the collection basin 116 and the outfall point 124. This illustrates the flexibility of the bluff penetrating outfall drainage system 100. The collection basin 116 may be positioned in a location best for collecting water. The outfall point 124 may be positioned based on considerations of the best position on or in the bluff base 128 for an outfall. The catch basin structure 120 is positioned based on obtaining specific downward slopes in the collection basin drain pipe and catch basin drain pipe. Thus the outfall point 124 and the collection basin 116 may be positioned without unduly restraining the position of each other. In the example of FIG. 2B, the collection basin 116 has been placed close to the outfall point 124. This will cause the catch basin drain pipe 122 to have a slope steeper than the desired range, if the positions of the collection basin 116, the catch basin structure 120 and the outfall point 124 are all in a straight line. Placing the catch basin structure 120 off from this line and farther from the bluff 104 than the collection basin 116 results in desirable slopes for the collection basin drain pipe 118 and the catch basin drain pipe 122.

Figure 3A:
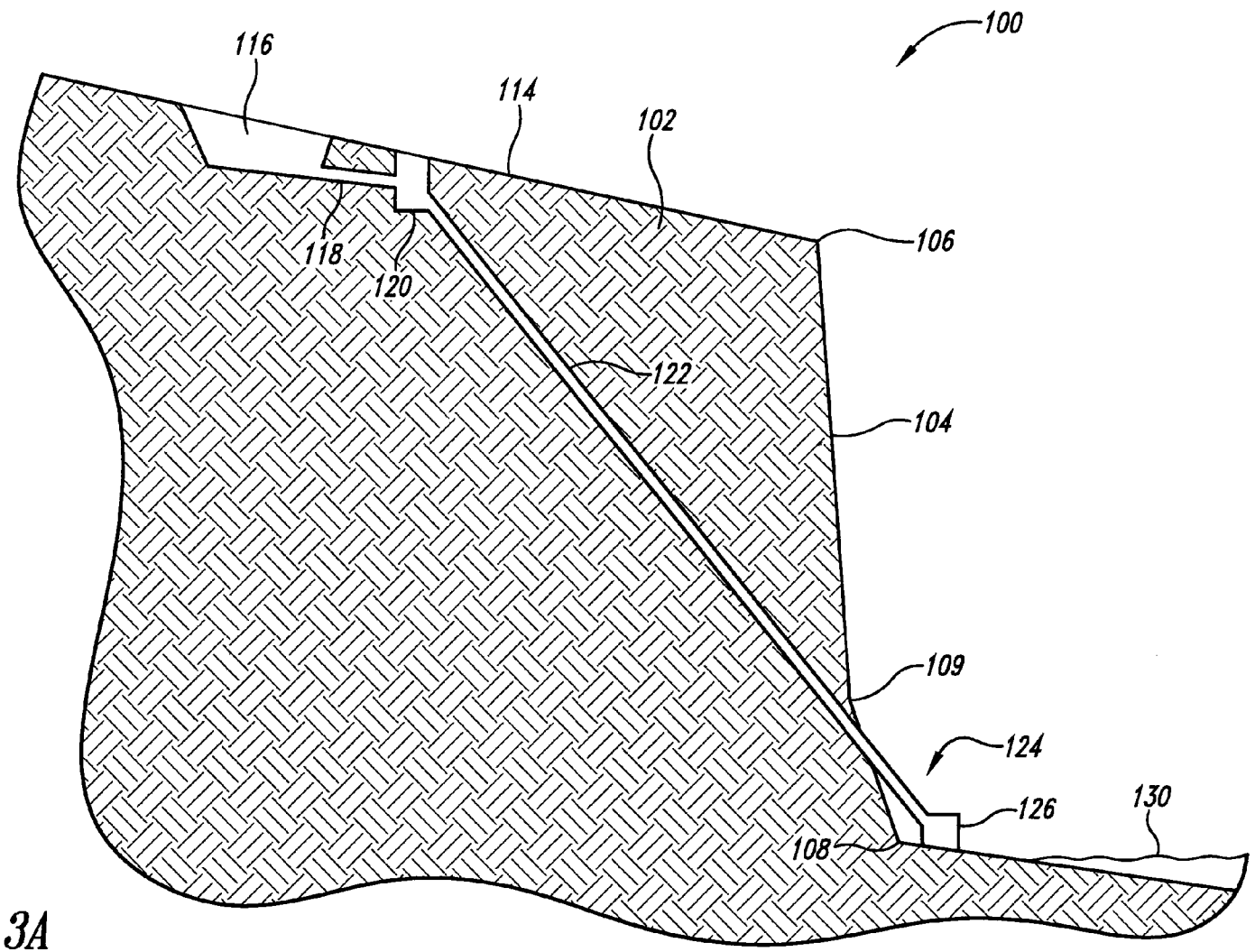
FIG. 3A is a cross-sectional side view of a third embodiment of a bluff penetrating outfall drainage system.
Figure 3B:
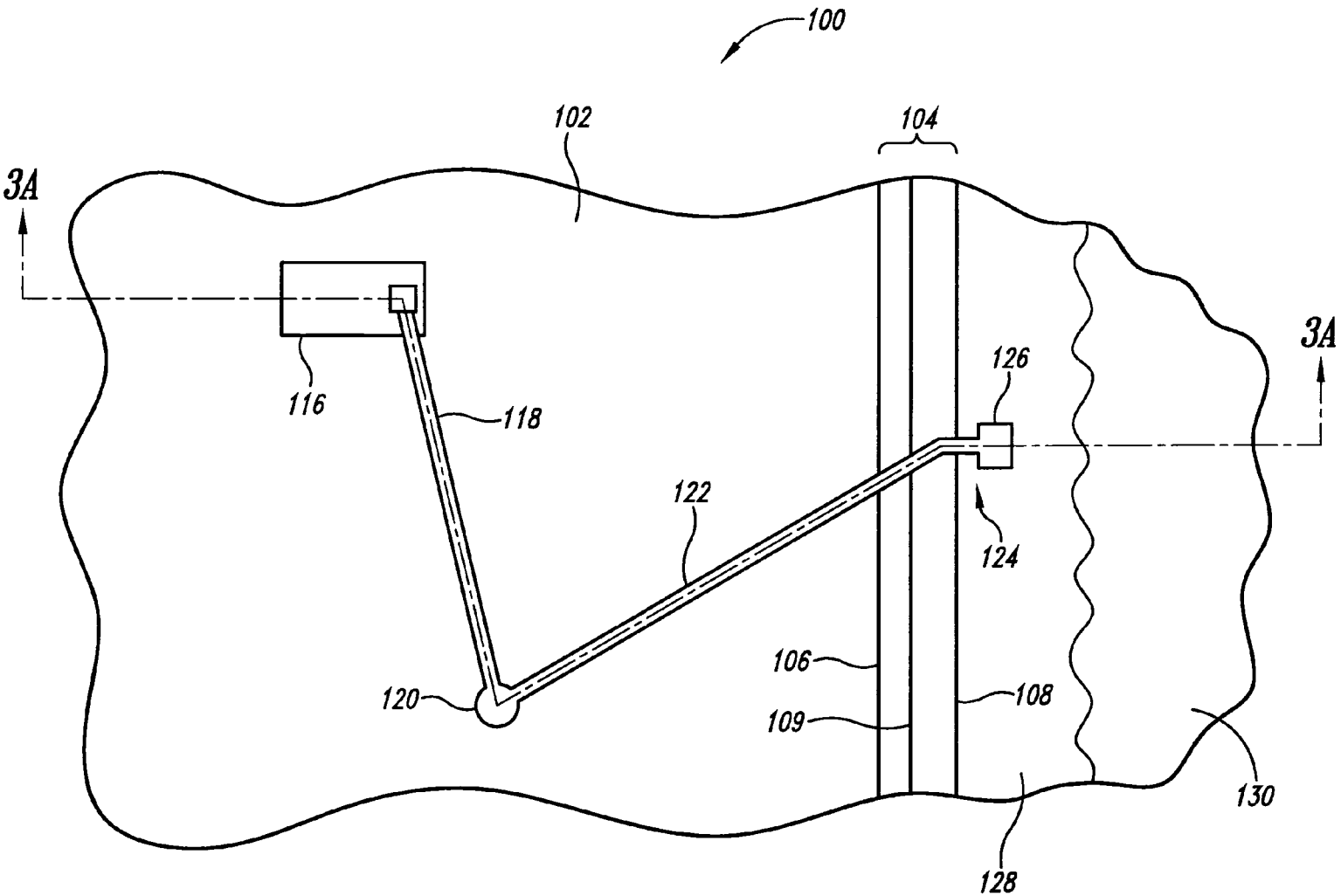
FIG. 3B is a top plan view of the embodiment of FIG. 3A.

FIG. 3A is the cross-sectional side view of a third embodiment of the bluff penetrating outfall drainage system 100. FIG. 3B is a top plan view of the same embodiment. Unlike the previous embodiments, in this embodiment the hilltop 114 increases in elevation with distance from the head of the bluff 106. In FIG. 3A, the catch basin drain pipe 122 appears to have a slope much steeper than 100%. However, FIG. 3B shows the catch basin drain pipe 122 is longer than it appears to be in FIG. 3A. When viewed from above, the catch basin structure 120 has been significantly offset from a line between the collection basin 116 and the outfall point 124 and positioned closer to the bluff 104 than the collection basin 116. This allows the slope of the catch basin drain pipe 122 to be in the desirable range of 30%-100% and the slope of the collection basin drain pipe 118 to have a slight downward slope towards the catch basin structure 120.

Figure 4A:
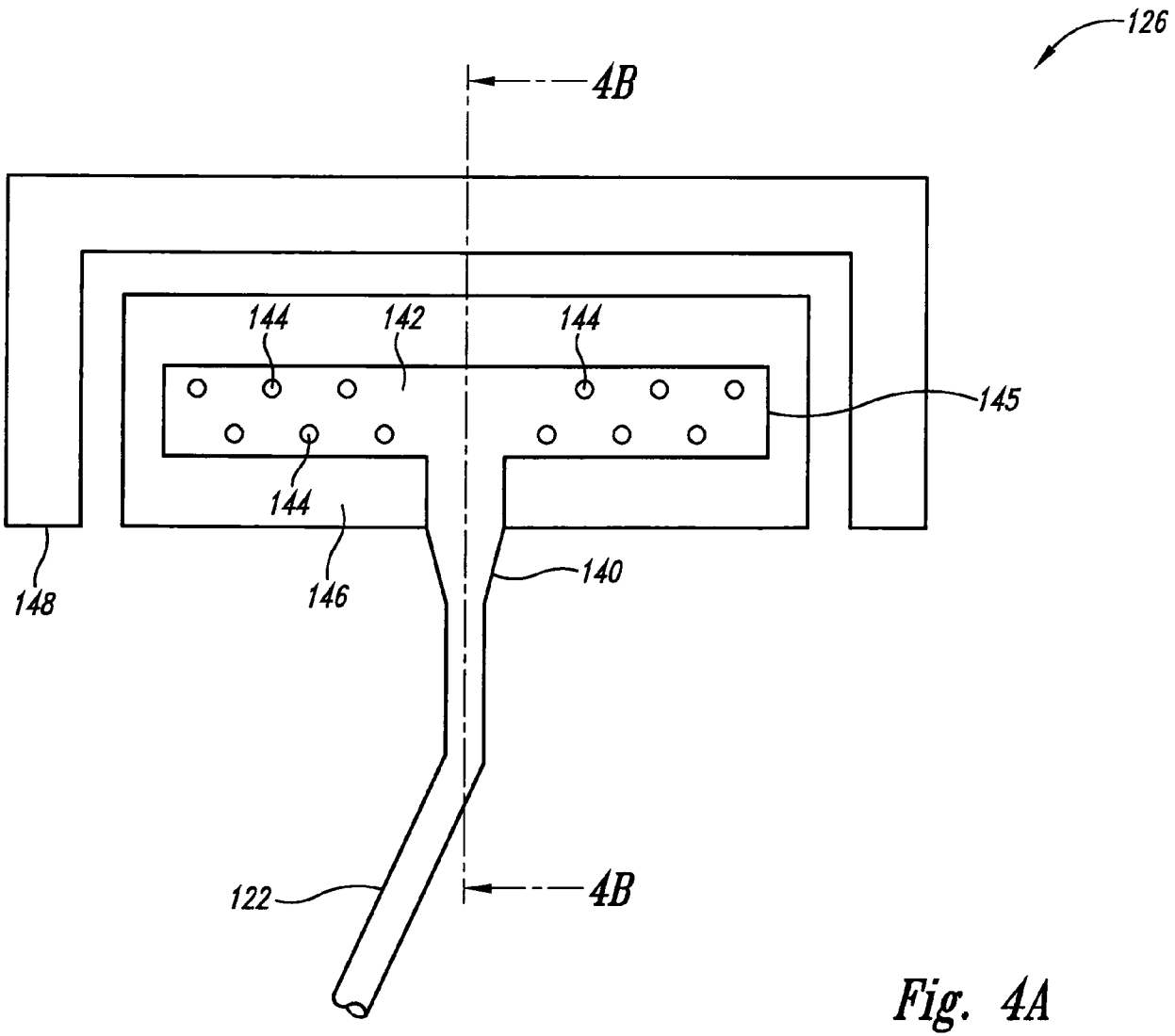
FIG. 4A is a top plan view of an embodiment of a dispersal structure.
Figure 4B:
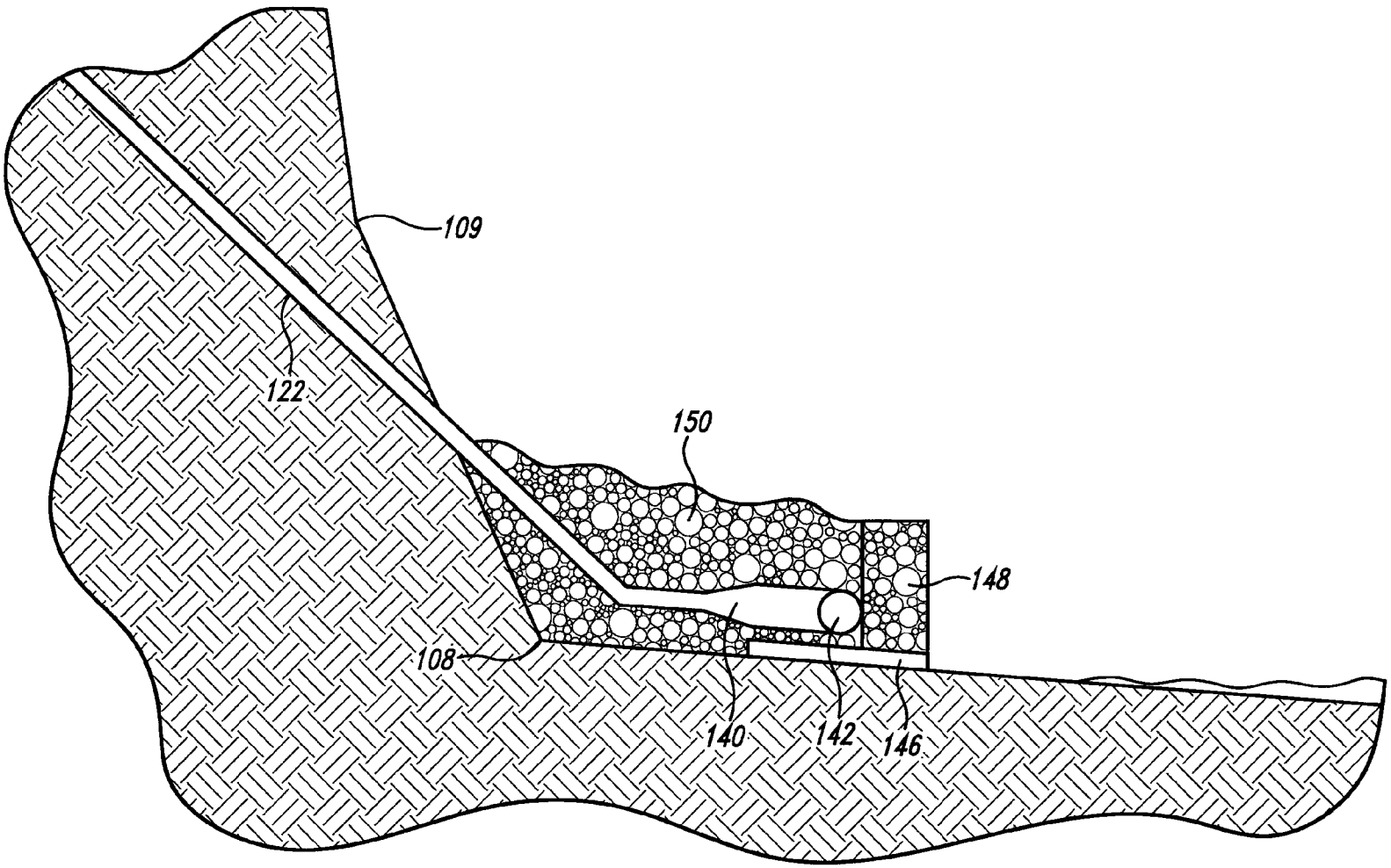
FIG. 4B is a cross-sectional side view of the dispersal structure embodiment of FIG. 4A taken along the line 4B-4B.

FIG. 4A is a top plan view of a fourth embodiment of the dispersal structure 126. FIG. 4B is a cross-sectional side view of the dispersal structure 126 embodiment of FIG. 4A. The dispersal structure 126 includes an expansion section 140, a spreader pipe 142 with perforations 144, an erosion resistant surface 146, a gabion basket 148, and a layer of loose rocks 150.

The expansion section 140 is coupled with the catch basin drain pipe 122. The expansion section 140 is a pipe with progressively increasing diameter. The geometry of the expansion section 140 serves to slow the flow of water received from the catch basin drain pipe 122.

The spreader pipe 142 is coupled with expansion section 140. The spreader pipe 142 is oriented traverse to the expansion section 140 and to the catch basin drain pipe 122. The spreader pipe 142 has numerous perforations 144 along its length. The spreader pipe 142 abruptly changes the direction of water received from the expansion section 140 and catch basin drain pipe 122, creating turbulence and reducing the kinetic energy of the water.

Removable end caps 145 are removably attached to the ends of the spreader pipe 142. The removable end caps 145 allow for maintenance access into the spreader pipe 142, particularly to clean out debris that may have been swept down from the collection basin 116.

The erosion resistant surface 146 is disposed underneath the spreader pipe 142. The erosion resistant surface 146 serves to prevent erosion of the ground underneath the spreader pipe 142 from high velocity water emitting from the perforations 144 in the spreader pipe 142.

The gabion basket 148 is disposed around the sides and front of the spreader pipe 142. The gabion basket 148 is a wire basket filled with rocks. The gabion basket 148 holds in place the layer of loose rocks 150 that covers the spreader pipe 142. The layer of the loose rocks 150 and the gabion basket 148 present a torturous path for jets of water emitting from the perforations 144 of the spreader pipe 142. The gabion basket 148 may comprise a plurality of independent baskets set close by each other and may be coupled by wire. The gabion basket 148 may be set apart from the spreader pipe 142 and may even be beyond the erosion resistant surface 146 as shown in FIG.

4A. Alternatively, the gabion basket 148 may abut the spreader pipe 142 and be fixed to the spreader pipe by wire or some other means.

Figure 5:
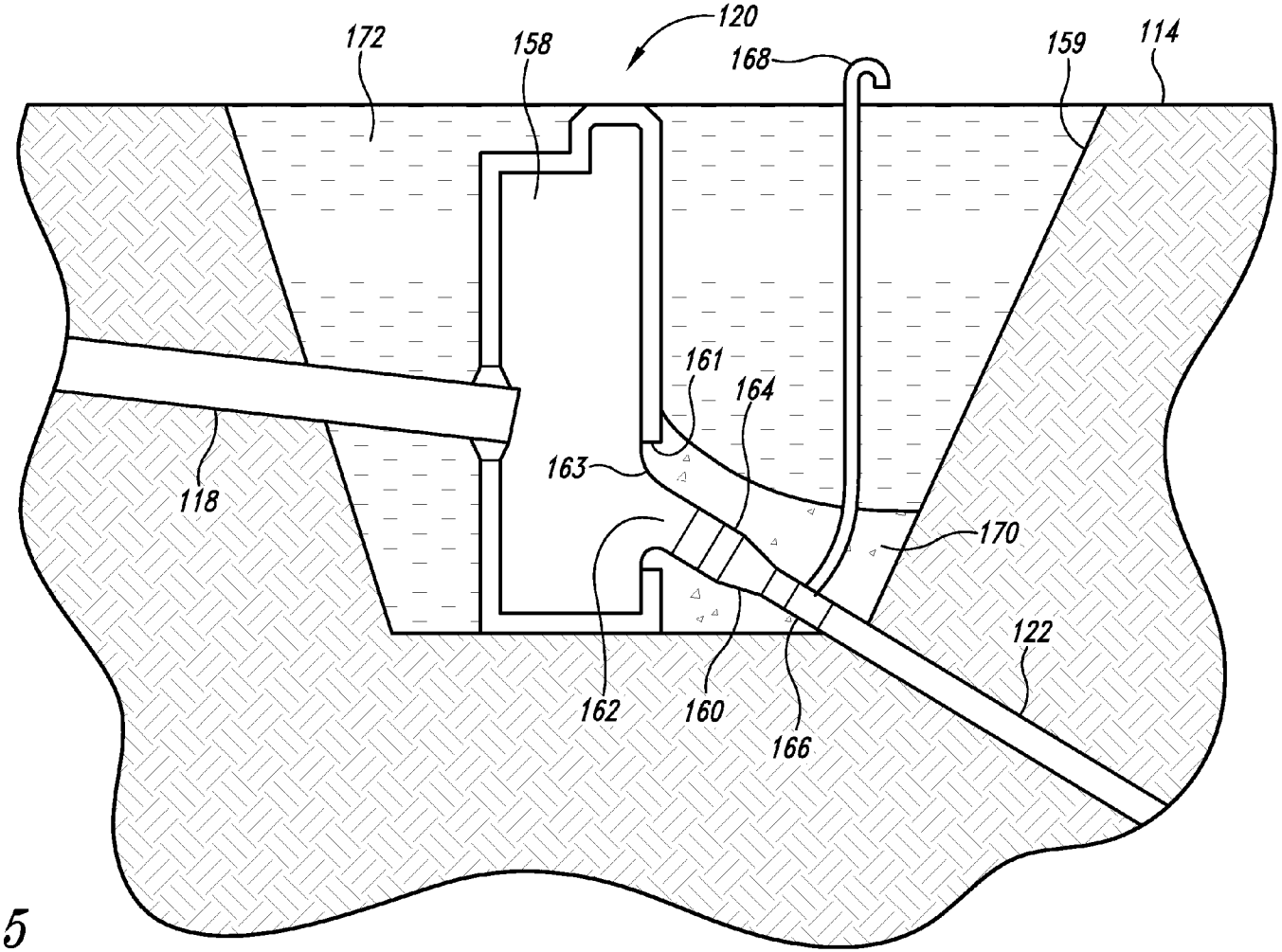
FIG. 5 is a cross-sectional side view of an embodiment of a catch basin structure.

FIG. 5 is a cross-sectional side view of an embodiment of a catch basin structure 120. The catch basin structure 120 comprises a catch basin 158 and adjoining structures including a reducing pipe 160, a cover structure 170, and a breathing tube 168.

The catch basin structure 120 is disposed in a catch basin hole 159 dug into the hill surface 114. The depth of the catch basin hole 159 should be sufficient to accommodate a desired downward slope in the collection basin drain pipe 118. Backfill 172 fills the catch basin hole 159 not occupied by the catch basin 158 and the other adjoining structures.

The reducing pipe 160 is attached to the end of the catch basin drain pipe 122. The reducing pipe 160 has a small aperture at the lower end that attaches to the catch basin drain pipe 122 and a large aperture at the upper end, and a portion with gradually decreasing aperture between the large aperture and small aperture. In this embodiment, the large aperture is 24 inches in diameter and the smaller aperture is 14 inches diameter, but other similarly proportioned apertures may be used. The length of the gradually reducing aperture portion reducing pipe 160 is at least as long as large aperture diameter, but may be longer. The reducing pipe 160 has the function of accelerating water entering the upper end with a venturi effect.

The breathing tube 168 is connected to the catch basin drain pipe 122. The breathing tube 168 prevents or reduces vapor lock in the catch basin drain pipe 122. Vapor lock can occur when water in the catch basin 158 is blocked or slowed from entering the reducing pipe 160 and catch basin drain pipe 122 due to air in these pipes. Without the breathing tube 168, as water flows in, this air will flow back through the reducer pipe 160, disrupting the acceleration of the water there. With the breathing tube 168, water leaving the catch basin 158 can push any air in front of it to the breathing tube, through which the air may escape. The breathing tube 168 is sized to be sufficient to prevent vapor lock. In this embodiment, the breathing tube 168 has a 2 inch inside diameter. In this embodiment, the breathing tube 168 is connected at a location on the catch basin drain pipe 122 immediately adjacent to the reducing pipe 160. In other embodiments, the breathing tube 168 may be located farther away from the reducing pipe 168. The breathing tube 168 connects to reducing tee 166. In this embodiment, the reducing tee 166 is an integral part of the catch basin drain pipe 122. In other embodiments, the reducing tee 166 is a separate part connected to the catch basin drain pipe 122 by welding or similar means.

The cover structure 170 abuts the catch basin 158 adjacent to an opening 161 in the catch basin 158. The opening 161 is larger than the large aperture of the reducing pipe 164. In this embodiment, the opening 161 is 36 inches in diameter, but another size opening 161 may be used. A channel 162 penetrates the cover structure 170, providing a conduit for water to flow from the opening 161 to the reducer pipe 164. The cover structure 170 has an entrance structure 163 that merges with walls of the catch basin 158 around the opening 161 and provides a sculpted, rounded and smooth transition from the opening 161 to the channel 162. The sculpted, rounded and smooth entrance structure 163 functions to reduce turbulent flow in water entering the channel 162 and facilitating vortex formation, both of which can increase the rate of flow of water into the catch basin drain pipe 122. The cover structure 170 is made of concrete poured around the catch basin drain pipe 122.

Figure 6:
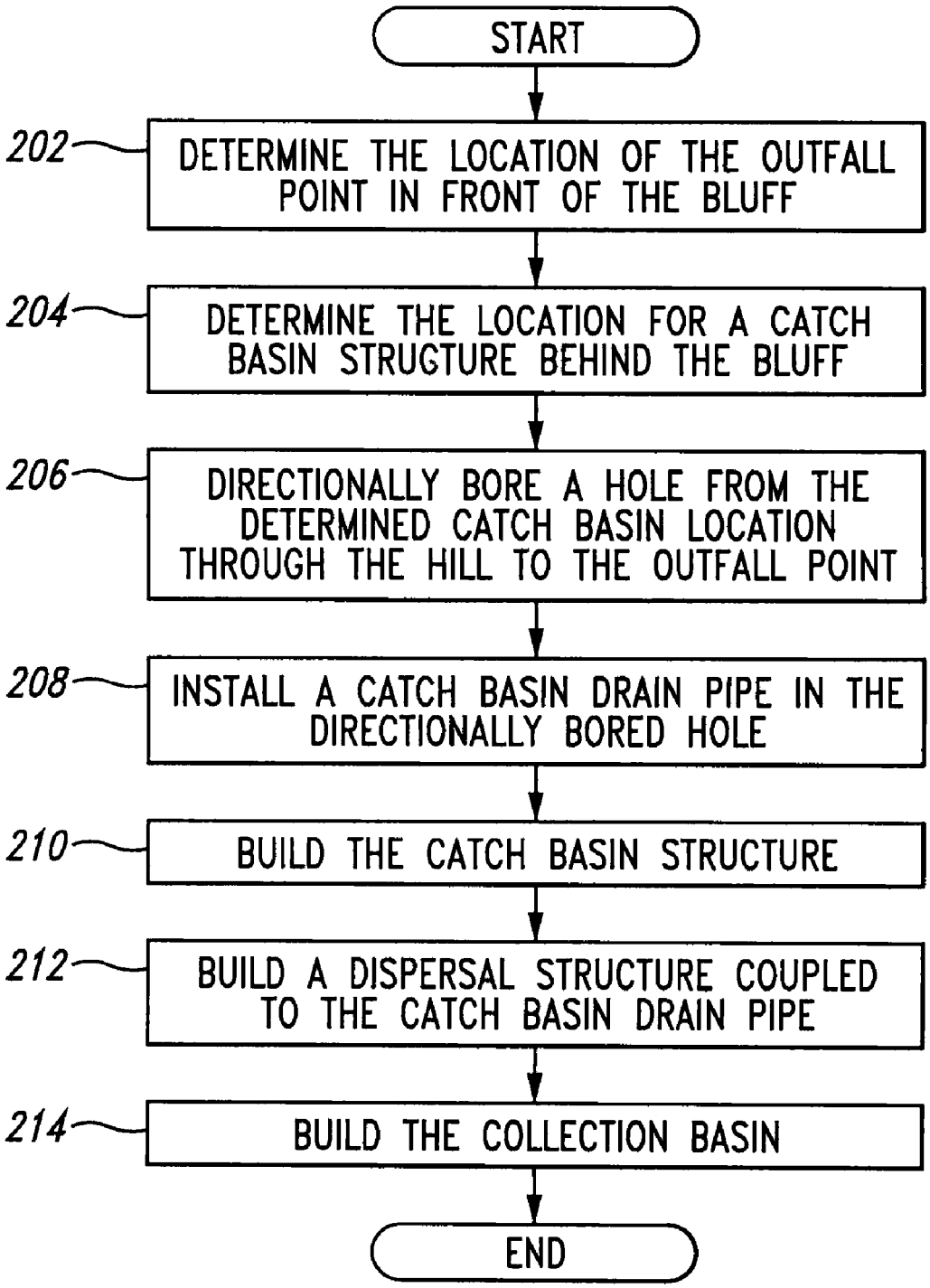
FIG. 6 is a flow diagram of a procedure for constructing a bluff penetrating outfall drain system.

FIG. 6 is a flow diagram of a method for constructing a bluff penetrating outfall drain system 100. Step 200 specifies determining a location for a collection basin behind a bluff. This determination is made based on factors that may include cost and the best elevation location to collect surface water.

Step 202 specifies determining the location for the outfall point in front of the bluff. This determination is made based on factors that may include cost and environmental impacts.

Step 204 specifies determining the location for a catch basin structure behind the bluff. This determination is made based on factors that include the locations of the collection basin and the outfall point, and based on obtaining desirable slopes for the collection basin drain pipe and the catch basin drain pipe.

Step 206 specifies directionally boring a hole from the determined catch basin location through the hill to the outfall point.

Step 208 specifies installing a catch basin drain pipe in the directionally bored hole.

Step 210 specifies building the catch basin structure. The catch basin structure must have sufficient depth in order to ensure a desirable downward slope in a collection basin drain pipe.

Step 212 specifies building a dispersal structure coupled to the catch basin drain pipe.

Step 214 specifies building the collection basin.

Figure 7:
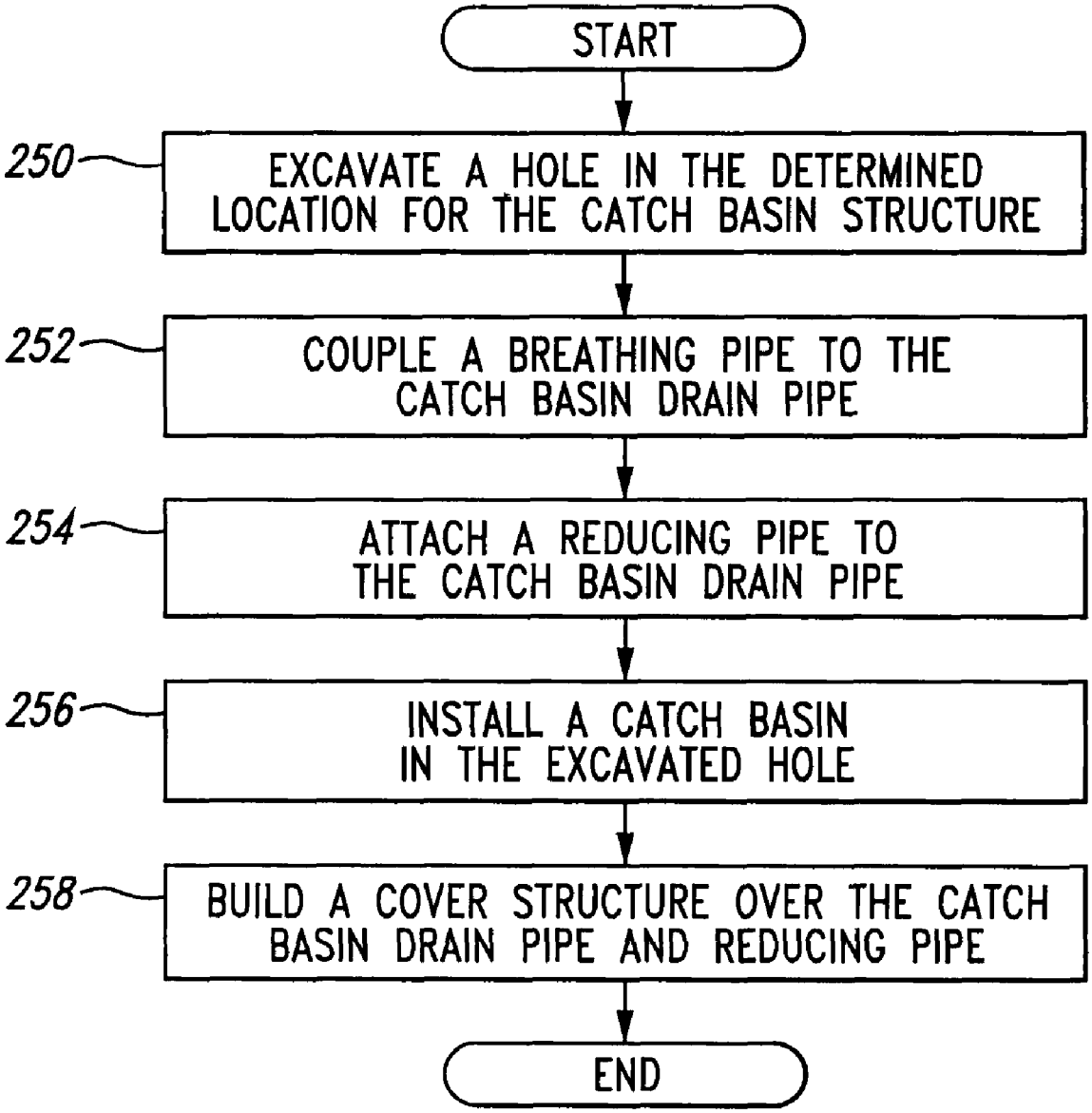
FIG. 7 is a flow diagram of a method for building the catch basin structure specified in the method shown in FIG. 6.

FIG. 7 is a flow diagram of a method for building the catch basin structure specified in the method shown in FIG. 6. Step 250 specifies excavating a hole in the determine location for the catch basin structure.

Step 252 specifies coupling a breathing pipe to the catch basin drain pipe.

Step 254 specifies attaching a reducing pipe to the catch basin drain pipe.

Step 256 specifies installing a catch basin in the excavated hole

Step 258 specifies building a cover structure over the catch basin drain pipe and reducing pipe. Typically, the cover structure is made by pouring concrete in the hole around the catch basin, catch basin drain pipe and reducing pipe, but other materials and methods may be used. The cover structure is formed with a channel running from an opening in the catch basin to the reducing pipe. The cover structure is formed with an entrance structure coupling the channel with an opening in the catch basin. The entrance is constructed so that the transition between the walls of the catch basin and the walls of the channel are sculpted, rounded and smooth.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A bluff penetrating outfall drainage system to remove surface water from atop a hill with a bluff on a side of the hill comprising:

a catch basin located behind the bluff;

a cover structure abutting the catch basin, the cover structure penetrated by a channel, the cover structure having an entrance structure coupling the channel with an opening in the catch basin, wherein the entrance structure is sculpted, round and smooth;

a reducer pipe having a large aperture in one end, a small aperture in the other end and a gradually reducing aperture in-between the large and small apertures, the end with the large aperture coupled with the channel;

a catch basin drain pipe coupled with the small aperture end of the reducer pipe, the catch basin drain pipe extending through the hill to an outfall point near a toe of the bluff; and a breathing pipe coupled to the catch basin drain pipe, the breathing pipe extending to above a surface of the hill.

2. The system of claim 1 wherein the catch basin is located in a position relative to the outfall point resulting in a desired downward slope for the catch basin drain pipe from the catch basin to the outfall point.

3. The system of claim 1, wherein the desired downward slope for the catch basin drain pipe from the catch basin to the outfall point is in the range of 30% to 100%.

4. The system of claim 1, further comprising a dispersal structure coupled to the catch basin drain pipe.

5. The system of claim 4 wherein the dispersal structure further comprises a spreader pipe with perforations, wherein the spreader pipe is coupled to the catch basin drain pipe, wherein the spreader pipe is oriented transverse to the catch basin drain pipe.

6. The system of claim 5 wherein the spreader pipe further comprises a removable end cap.

7. The system of claim 5 wherein the dispersal structure further comprises:

an erosion-resistance surface under the spreader pipe;

a gabion basket coupled with the spreader pipe; and a layer of loose rocks disposed over the spreader pipe.

8. The system of claim 1 wherein the outfall point is below the knee of the bluff.

9. The system of claim 1 wherein the outfall point near the bluff toe further comprises the outfall point within a distance of the bluff toe equal to 25% of the elevation gain of the bluff.

10. The system of claim 1, further comprising:

a collection basin located behind the bluff; and a collection basin drain pipe extending from the collection basin to the catch basin.

11. A method to construct a drainage outfall system through a hill with a bluff on one side of the hill comprising:

excavating a hole for a catch basin atop the hill and behind the bluff;

directionally boring a hole from the hole for the catch basin through the hill to an outfall point close to a toe of the bluff;

installing a catch basin drain pipe in the directionally bored hole;

coupling a breathing pipe to the catch basin drain pipe;

attaching a reducing pipe to the catch basin drain pipe;

installing the catch basin in the hole for the catch basin;

building a cover structure over the reducing pipe, the cover structure penetrated by a channel, the cover structure having an entrance structure coupling the channel with an opening in the catch basin, wherein the entrance structure is sculpted, rounded and smooth;

installing a dispersal structure at the outfall point;

coupling the catch basin drain pipe to the dispersal structure;

building a collection basin; and installing a collection basin drain pipe from the collection basin to the catch basin.

12. The method of claim 11, further comprising:

determining a location for a collection basin behind the bluff;

determining a location for an outfall point near the toe of the bluff; and determining a location for a catch basin behind the bluff based on factors that include the location of the collection basin, and the location of the outfall point, a desired slope for a collection basin drain pipe between the collection basin and the catch basin and a desired slope for a catch basin drain pipe between the catch basin and the outfall point.

13. The system of claim 12, wherein the desired slope for the catch basin drain pipe from the catch basin to the outfall point is in the range of 30% to 100%.

14. A drainage system to remove surface water from a watershed atop a hill behind a bluff, the system comprising:

(a) a collection basin configured to collect the surface water from the watershed;

(b) a first pipe configured to drain the water from the collection basin;

(c) a catch basin structure configured to receive the water from the first pipe, the catch basin structure comprising:

(i) a catch basin comprising an opening, (ii) a cover structure abutting the catch basin, the cover structure penetrated by a channel, the cover structure having an entrance structure coupling the channel with the opening in the catch basin, wherein the entrance structure is sculpted, round, and smooth, (iii) a reducer pipe having a large aperture in one end, a small aperture in the other end, and a gradually reducing aperture in-between the large and small apertures, the end with the large aperture coupled with the channel, and (iv) a breathing pipe;

(d) a second pipe coupled with the small aperture end of the reducer pipe, the breathing pipe being coupled to the second pipe and extending to above a surface of the hill, the second pipe being configured to drain the water from the catch basin structure, through the hill, to an outfall point close to a toe of the bluff; and (e) a dispersal structure configured to receive the water from the second pipe and configured to distribute the water over a section of ground.

15. The system of claim 14, wherein the second pipe has a slope in the range of 30% to 100%.

16. The system of claim 14 wherein the dispersal structure comprises:

a spreader pipe configured to distribute the water through perforations in the spreader pipe;

an erosion-resistance surface disposed beneath the spreader pipe and configured to protect the section of ground from erosion by the water; and a layer of loose rocks over the spreader pipe and configured to slow the water.

* * * * *